United States Patent [19]

Johns

[11] 4,425,565

[45] * Jan. 10, 1984

[54] MULTIPLE RESONANT COIL USING DISTRIBUTED CAPACITY BETWEEN TURNS

[76] Inventor: Robert H. Johns, 3379 Papermill Road, Huntingdon Valley, Pa. 19006

[ * ] Notice: The portion of the term of this patent subsequent to Jun. 5, 1999 has been disclaimed.

[21] Appl. No.: 373,857

[22] Filed: May 3, 1982

Related U.S. Application Data

[63] Continuation-in-part of Ser. No. 327,359, Dec. 4, 1981, which is a continuation-in-part of Ser. No. 249,440, Mar. 31, 1981, Pat. No. 4,334,228, which is a continuation-in-part of Ser. No. 222,241, Jan. 2, 1981, Pat. No. 4,335,386, which is a continuation-in-part of Ser. No. 162,928, Jul. 17, 1980, abandoned.

[51] Int. Cl.[3] ..... H01Q 1/00

[52] U.S. Cl. ..... 343/722; 333/175

[58] Field of Search ..... 343/722, 749; 333/175, 333/185

[56] References Cited

U.S. PATENT DOCUMENTS 3,560,895 2/1971 Matsumoto ..... 333/175

*Primary Examiner*—Eli Lieberman

[57] ABSTRACT

A circuit having several resonant frequencies is disclosed. The capacitance between coils is used instead of discrete capacitor components. One frequency is the self-resonant frequency of a large single layer coil and another frequency is the resonance of the double layered end of the circuit. The use of such multiple frequency circuits as antenna traps and loading coils is shown.

3 Claims, 3 Drawing Figures

MULTIPLE RESONANT COIL USING DISTRIBUTED CAPACITY BETWEEN TURNS

CROSS-REFERENCES

This application is a continuation in part of my application Ser. No. 327,359 filed Dec. 4, 1981, which is a continuation in part of my application Ser. No. 249,440 filed Mar. 31, 1981, now U.S. Pat. No. 4,334,228, issued June 8, 1982, which is a continuation in part of my application Ser. No. 222,241 filed Jan. 2, 1981, now U.S. Pat. No. 4,335,386, issued June 15, 1982, which is a continuation in part of my application Ser. No. 162,928 filed July 17, 1980, now abandoned.

SUMMARY OF THE INVENTION

This invention provides a circuit that is resonant on two frequencies simultaneously, made from insulated wire coils with no separate capacitor components. Distributed capacity between turns and the capacity between layers of turns supplies the capacitance to tune the inductance of the coils to parallel resonant frequencies. A relatively long main coil is used, with a second coil smaller than the first wound on top of one end of the main coil. These coils are wound in the same direction, in a series-aiding relationship, requiring a cross-connection between opposite ends of the coils. One resonant frequency is the self-resonant frequency of the large main coil. Its inductance together with the distributed capacitance between turns establishes a parallel resonant circuit, the higher of the two frequencies of this circuit. The second resonant frequency is established by the two layers at the end of the main coil. Their combined inductance and the capacitance between them produce a lower parallel resonant frequency.

Very simple, lightweight, and low cost circuits may be built according to this invention. One field where they may be usefully employed is in multiband antenna traps and loading coils.

PRIOR ART

Multiple frequency circuits are well known in the field of high frequency antennas, as illustrated by Pichitino in U.S. Pat. No. 2,898,590. These circuits use capacitor components rather than the intercoil capacity of this invention and shown also in my co-pending application Ser. No. 327,359.

Circuits having but one resonant frequency that use the capacitance between coils for the circuit capacitor are shown by U.S. Pat. Nos. Doty 4,255,728 and Matsumoto 3,560,895. Other single frequency circuits are shown in my co-pending applications Ser. Nos. 249,440 (filed Mar. 31, 1981) and 222,241 (filed Jan. 2, 1981).

DETAILED DESCRIPTION OF THE INVENTION

Figure 1:
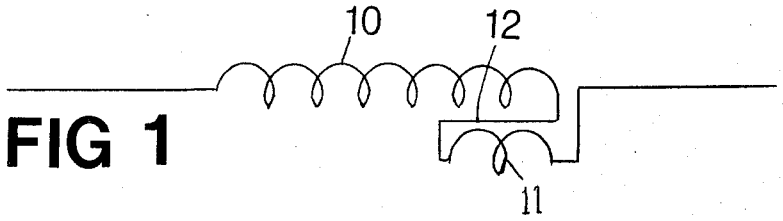
FIG. 1 is a circuit diagram of this invention.

In FIG. 1, 10 is the main large coil with smaller coil 11 placed near one end of the main coil. The small coil

11 may be wrapped around the main coil, inside the main coil, or between the turns of the main coil. Cross-connection wire 12 joins opposite ends of the two coils 10 and 11.

Figure 2:
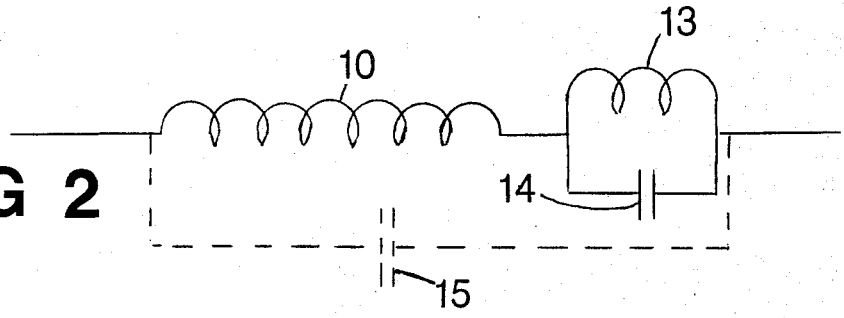
FIG. 2 is a circuit diagram showing the two parallel resonant circuits giving rise to the two frequencies of this invention.

FIG. 2 shows how the coils are believed to function in producing two resonant frequencies. Small inductance 13 is made up of coil 11 and an end portion of coil 10, not clearly defined, but that portion that is inductively and capacitively coupled to coil 11. Capacitor 14 is the combined distributed capacity of these coils and the interlayer capacitance between them. The parallel combination of inductance 13 and capacitor 14 produce the lower of the two resonant frequencies. The remaining portion of large coil 10 is in series with this resonant circuit.

Capacitor 15 is made up of the distributed capacitance between turns of the main coil 10. This is in parallel with the inductance of coil 10 to form another resonant frequency higher than the end resonant circuit frequency. This self-resonant frequency is higher because the capacity 15 is very small.

In a multiple frequency circuit wound from #14 stranded copper wire with 1/32 in cross-linked polyethylene insulation on a cylindrical form, having 80 turns in the main coil and $7\frac{1}{2}$ turns in the second coil wound at the end of the main coil, the higher frequency is approximately 29 MHz and the lower frequency is approximately 21 MHz. This multiple frequency circuit is approximately one foot long.

Figure 3:
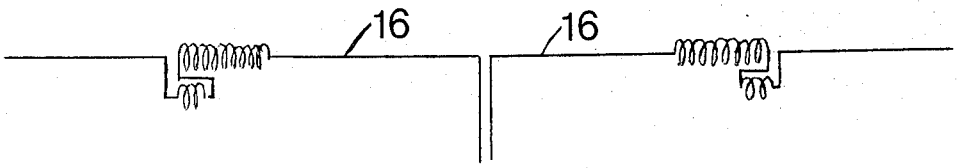
FIG. 3 shows a radio antenna with the multiple frequency circuit of this invention installed as a combined loading coil and multiple frequency trap.

FIG. 3 shows a multiband dipole antenna using the multiple frequency circuit as a combined loading coil and antenna trap covering two bands. The inner segments of the antenna 16 are of a length to make up a half wave dipole on the highest frequency the antenna will serve, 29 MHz for example. The self resonance of the large coil serves as a trap at this frequency, isolating the center portion from the rest of the antenna to preserve resonance. At a lower frequency band, 21 MHz, the main coil serves as a loading coil to physically shorten the length of antenna to produce half wave dipole resonance, and the end resonant circuit serves as a trap to isolate the 21 MHz dipole from the rest of the antenna. At a still lower frequency band the multiple frequency circuit serves as a large loading coil. If the overall antenna is made resonant at 7 MHz, its length is approximately 34 feet, only slightly more than half the length of a full sized dipole for 7 MHz.

There are several important new results offered by this invention. A very rugged and low cost construction may be realized for multiple frequency circuits, since capacitors have been eliminated. The continuously wound coils also eliminate the electrical connections within antenna traps made according to this invention, a place where traps commonly weather and fail. In addition, this multiple frequency circuit can simplify the construction of multiband antennas by combining the functions of two traps and a loading coil into one device.

I claim:

1. A circuit having more than one resonant frequency comprising a pair of circuit connection wires, a main coil of insulated wire, a second coil of insulated wire having fewer than half the number of turns of said main coil, capacitively coupled to said main coil near one end of said main coil, with an electrical cross-connection joining opposite ends of said main coil and said second coil, whereby the self-resonance of the main coil is one of the resonant frequencies of the multiple frequency circuit and the resonant frequency of the second coil together with the portion of the main coil that is coupled to it is another resonant frequency of the multiple frequency circuit, electrical connections between said circuit connecting wires and one end of said main coil and one end of said second coil that are not part of said cross-connection.

2. A circuit according to claim 1 in which said second coil is wrapped around an end portion of said main coil.

3. A circuit according to claim 1 in which said electrical cross-connection between coils is a continuation of the wire of said coils, whereby the entire circuit is made from a continuous length of wire.

* * * * *